US010602904B2

(12) United States Patent
Weinberger

(10) Patent No.: US 10,602,904 B2
(45) Date of Patent: Mar. 31, 2020

(54) CLEANING TOOL WITH CHAINMAIL ABRADER

(71) Applicant: MIW Associates LLC, Havertown, PA (US)

(72) Inventor: Marvin Weinberger, Havertown, PA (US)

(73) Assignee: MIW Associates LLC, Havertown, PA (US)

( * ) Notice: Subject to any disclaimer, the term of this patent is extended or adjusted under 35 U.S.C. 154(b) by 141 days.

(21) Appl. No.: 15/916,863

(22) Filed: Mar. 9, 2018

(65) Prior Publication Data

US 2018/0263455 A1 Sep. 20, 2018

Related U.S. Application Data

(60) Provisional application No. 62/472,918, filed on Mar. 17, 2017.

(51) Int. Cl.

| | |
|---|---|
| ***A47L 13/06*** | (2006.01) |
| ***A47L 17/08*** | (2006.01) |
| ***A47L 13/42*** | (2006.01) |
| ***B25G 3/14*** | (2006.01) |
| ***A47L 13/46*** | (2006.01) |
| ***B25G 1/10*** | (2006.01) |

(52) U.S. Cl.

CPC ..... *A47L 13/06* (2013.01); *A47L 13/42* (2013.01); *A47L 13/46* (2013.01); *A47L 17/08* (2013.01); *B25G 1/102* (2013.01); *B25G 3/14* (2013.01)

(58) Field of Classification Search

CPC ..... A47L 13/06; A47L 13/42; A47L 13/46; A47L 17/08; B25G 1/102; B25G 3/14

See application file for complete search history.

(56) References Cited

U.S. PATENT DOCUMENTS

| | | | | |
|---|---|---|---|---|
| 99,475 A | | 2/1870 | Rhindelander | |
| 119,791 A | * | 10/1871 | Scherer | A47L 13/16 15/208 |
| 388,990 A | * | 9/1888 | Miller | A47L 13/16 15/209.1 |

(Continued)

FOREIGN PATENT DOCUMENTS

| | | | |
|---|---|---|---|
| JP | 03-242111 | A | 10/1991 |
| JP | 2008-206798 | A | 9/2008 |
| WO | 9823201 | A1 | 6/1998 |

OTHER PUBLICATIONS

"Sir-Scrubbington" product literature, accessed Amazon.com on Mar. 8, 2018, available Jun. 1, 2017.

*Primary Examiner* — Marc Carlson

(74) *Attorney, Agent, or Firm* — Duane Morris LLP

(57) ABSTRACT

A cleaning tool for use in abrading a surface for cleaning the surface includes a resiliently deformable backing member insert, and a chain mail abrader enclosure comprising a chain mail body having a plurality of interlinked rings. The chain mail abrader enclosure is configured to allow for insertion and removal of the resiliently deformable backing member insert. The resiliently deformable backing member is disposable within the chain mail abrader enclosure such that the backing member is positioned against the chain mail body to allow the chain mail body to conform to contours of the surface during abrading.

11 Claims, 19 Drawing Sheets

(56) References Cited

U.S. PATENT DOCUMENTS 422,214 A * 2/1890 Hinds ..... A47L 13/16 15/209.1
428,144 A * 5/1890 Russell ..... B01F 1/0027 422/266
514,840 A * 2/1894 Streeter ..... A47L 13/16 15/209.1
587,198 A 7/1897 Gilroy
681,707 A * 9/1901 Johnson ..... A01K 13/002 119/630
717,004 A * 12/1902 Hunt ..... A47L 13/16 15/209.1
921,136 A * 5/1909 Marsolais ..... A01K 13/002 119/630
1,246,959 A 11/1917 Litot
1,493,670 A 5/1924 Galvin
1,529,690 A 3/1925 Kemyes
1,741,223 A 12/1929 Case
1,903,520 A 4/1933 Sturgis
2,100,138 A 11/1937 Heldt
2,140,578 A * 12/1938 Goodloe ..... A47L 13/02 15/111
2,156,494 A 5/1939 Goodloe
2,259,025 A * 10/1941 Cosgro ..... A47L 17/08 15/229.11
2,599,271 A 6/1952 Michel
2,891,270 A 6/1959 Reiter
2,941,225 A 6/1960 Milton
3,055,034 A 9/1962 Halg
3,284,833 A 11/1966 Von Tersch et al.
3,583,020 A 6/1971 Bateman
3,696,563 A 10/1972 Rands
3,969,090 A 7/1976 Sasena
4,071,983 A 2/1978 Thielen
4,091,579 A 5/1978 Giangiulio
4,473,217 A 9/1984 Hashimoto
4,534,080 A 8/1985 Young
4,925,516 A 5/1990 Phillips et al.
4,936,055 A 6/1990 Ishihara
5,098,493 A 3/1992 Taylor
5,511,241 A 4/1996 Ziegler
5,581,840 A 12/1996 Chen
5,735,014 A 4/1998 Noga
6,725,492 B2 4/2004 Moore et al.
6,944,899 B2 9/2005 Gladney
7,044,560 B1 5/2006 Miller et al.
8,225,451 B2 * 7/2012 Weinberger ..... A46B 7/04 15/111
D702,009 S * 4/2014 Knapp ..... D32/40
8,683,641 B2 4/2014 Weinberger et al.
8,870,630 B2 10/2014 Weinberger et al.
9,227,301 B2 1/2016 Weinberger et al.
D758,035 S * 5/2016 Mulvany ..... D32/40
9,403,261 B2 8/2016 Weinberger et al.
D815,783 S * 4/2018 Neiman ..... D32/40
D845,570 S * 4/2019 Xu ..... D32/40
2003/0019059 A1 1/2003 Rooke
2003/0028989 A1 * 2/2003 Peterson ..... A47L 13/06 15/229.11
2005/0136238 A1 * 6/2005 Lindsay ..... A47L 13/16 428/304.4
2006/0016034 A1 1/2006 Hillenbrand
2007/0157945 A1 7/2007 Lhoyer et al.
2009/0188061 A1 7/2009 Cybulski et al.
2012/0023689 A1 * 2/2012 Weinberger ..... A47J 43/288 15/111
2012/0028551 A1 * 2/2012 Weinberger ..... A47J 43/288 451/526
2012/0028554 A1 2/2012 Weinberger et al.
2017/0008039 A1 * 1/2017 Weinberger ..... A47J 43/288
2018/0132689 A1 * 5/2018 Neiman ..... A47L 13/07
2018/0263455 A1 * 9/2018 Weinberger ..... A47L 13/46

* cited by examiner

CLEANING TOOL WITH CHAINMAIL ABRADER

CROSS REFERENCE TO RELATED APPLICATIONS

This application claims priority to U.S. Provisional Patent Application No. 62/472,918 filed Mar. 17, 2017, the entirety of which is hereby incorporated by reference herein.

FIELD OF THE INVENTION

The present invention relates generally to the field of cleaning tools, and more particularly to cleaning tools for scraping grills, pans, cooking surfaces and the like.

BACKGROUND OF THE INVENTION

Despite numerous household cleaning solutions for grill, cast-iron cookware, and kitchenware, consumers are limited in the tools available to effectively clean these items in a safe and effective manner. Currently some consumers clean cast-iron cookware with hunks of chain mail sheets. Chain mail is an effective cleaning surface for removing stubborn and baked on cooking debris. However, the problem with cleaning cooking grills or cast-iron cookware with chain mail is that consumers are required to use their fingers or other tools to force the chain mail into the crevices, which is difficult, uncomfortable and messy. In addition, chain mail by itself does not provide an effective gripping surface. Presently, consumers are required to ball chain mail sheets up or clean in a manner that causes the chain mail to slip on the surface, which reduces the cleaning effectiveness.

SUMMARY OF THE INVENTION

A cleaning tool for use in abrading a surface for cleaning the surface includes a resiliently deformable backing member insert, and a chain mail abrader enclosure comprising a chain mail body having a plurality of interlinked rings. The chain mail abrader enclosure is configured to allow for insertion and removal of the resiliently deformable backing member insert. The resiliently deformable backing member is disposable within the chain mail abrader enclosure such that the backing member is positioned against the chain mail body to allow the chain mail body to conform to contours of the surface during abrading.

A cleaning tool for use in abrading a surface for cleaning the surface, includes: a resiliently deformable backing member comprising a wire form spring having a bulbous shape; a chain mail abrader enclosure including a chain mail body having a plurality of interlinked rings, wherein the resiliently deformable backing member is disposed within the chain mail abrader enclosure such that the backing member is positioned against the chain mail body to allow the chain mail body to conform to contours of the surface during abrading.

A cleaning tool for use in abrading a surface for cleaning the surface, includes: a chain mail abrading device comprising: a sponge; and a chain mail enclosure, the chain mail enclosure having a chain mail body having a plurality of interlinked rings; wherein the sponge is disposed within the chain mail abrader enclosure such that the sponge is positioned against the chain mail body to allow the chain mail body to conform to contours of the surface during abrading; and a handle detachably coupled to the chain mail abrading device.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
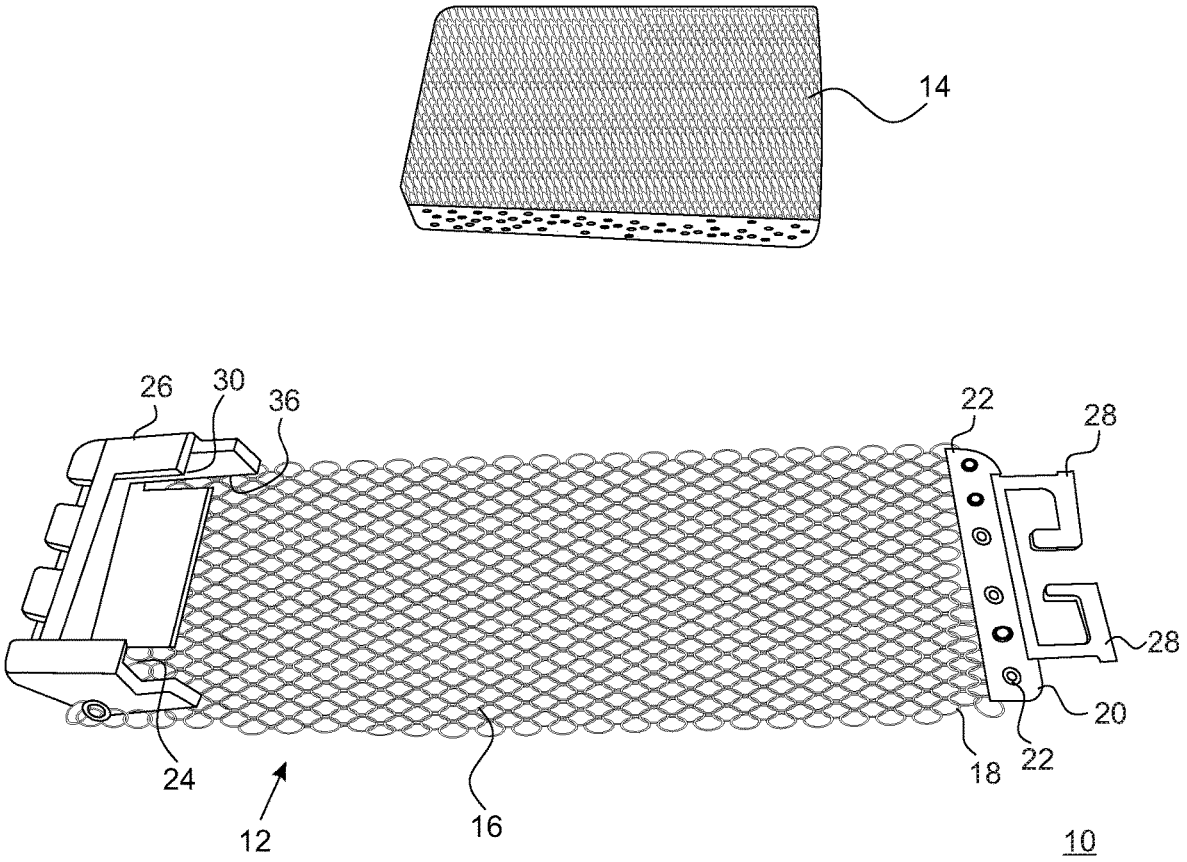
FIG. 1 illustrates an embodiment of a cleaning tool, in an open configuration, having a chain mail abrader and a sponge.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

A unique cleaning tool is disclosed for cleaning barbecue grills and cast-iron cookware, and for other kitchen and household uses as well as food-service applications. In embodiments, the cleaning tool includes a sheet of chain mail of various dimensions, typically rectilinear, which enrobes a flexible backing of varying stiffness and absorption qualities. In embodiments, the flexible backing includes a sponge, such as one made from cellulose wood fibers or foamed plastic polymers. In embodiments, the sponge may be formed from closed cell silicone, for example made from gum based polydimethylsiloxane (PMDS).

According to various embodiments, one end of the chain mail sheet is coupled to an attachment member and an opposing end of the chain mail sheet is coupled to a head configured to couple to the attachment member.

In certain embodiments a cleaning pouch tool is disclosed, in which both ends of the chain mail sheet are coupled to an attachment member and configured to form a pocket, wherein a cleaning implement (i.e. a sponge) may be disposed in the pocket. The cleaning implement serves as a flexible, resiliently/elastically deformable (e.g., compressible) backing member for the chain mail abrader that allows the chain mail to be more easily handled, allows the chain mail to better conform to the cleaning surface and also serves to hold a cleaning solution (e.g., water and soap).

In certain embodiments, the cleaning tool includes a spring backing to which the chain mail is attached. The spring provides a flexible member that serves as a body for supporting the chainmail cleaning surface and (optionally) includes a grip or handle for the cleaning tool.

According to various embodiments of the present disclosure, a cleaning tool is provided comprising a chain mail sheet configured to envelop a flexible backing. In some embodiments, the chain mail sheet may be of various dimensions. In some embodiments, the flexible backing may be a sponge of varying stiffness and absorption qualities. In various embodiments, the flexible backing is a kitchen sponge. In some embodiments, the chain mail sheet is configured to envelop the flexible backing so that it fits snugly. The cleaning tool, according to some embodiments, is configured to clean a completely flat, commercial griddle surface, wherein the backing is a stiffener.

In various embodiments, the flexible insert is a sponge. In some embodiments, the flexible insert is rectilinear in shape. In various embodiments, the flexible insert is a rod or an irregular shape (e.g., ravioli shape). In various embodiments, the flexible insert has an oval shape.

Figure 2:
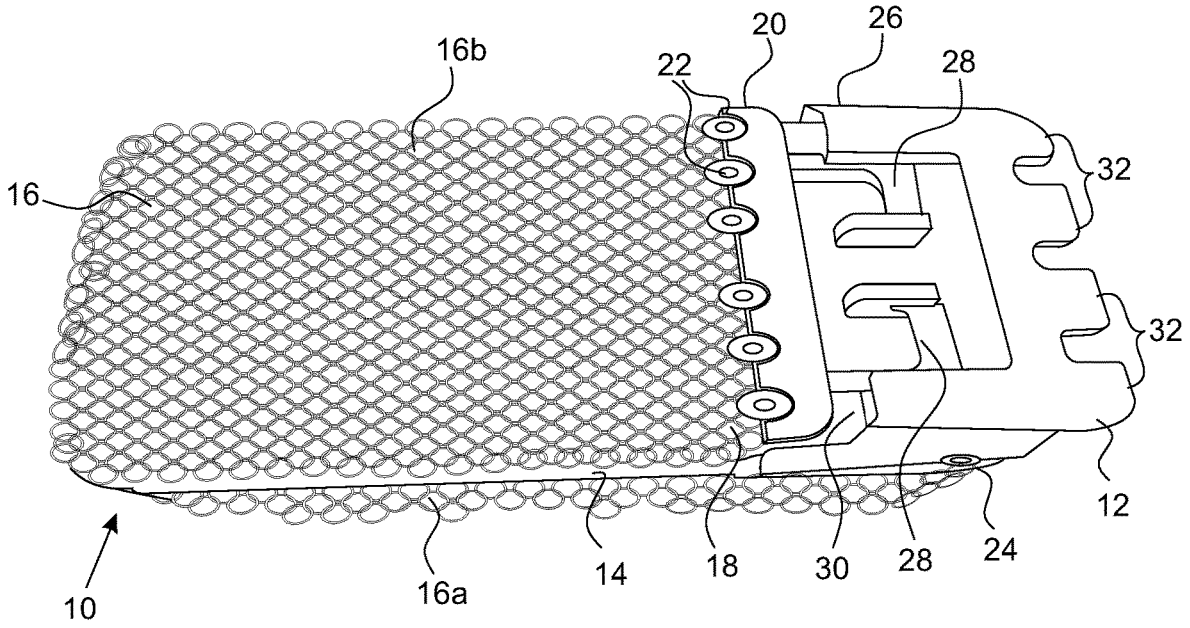
FIG. 2 illustrates the cleaning tool of FIG. 1 is a closed configuration.
Figure 3:
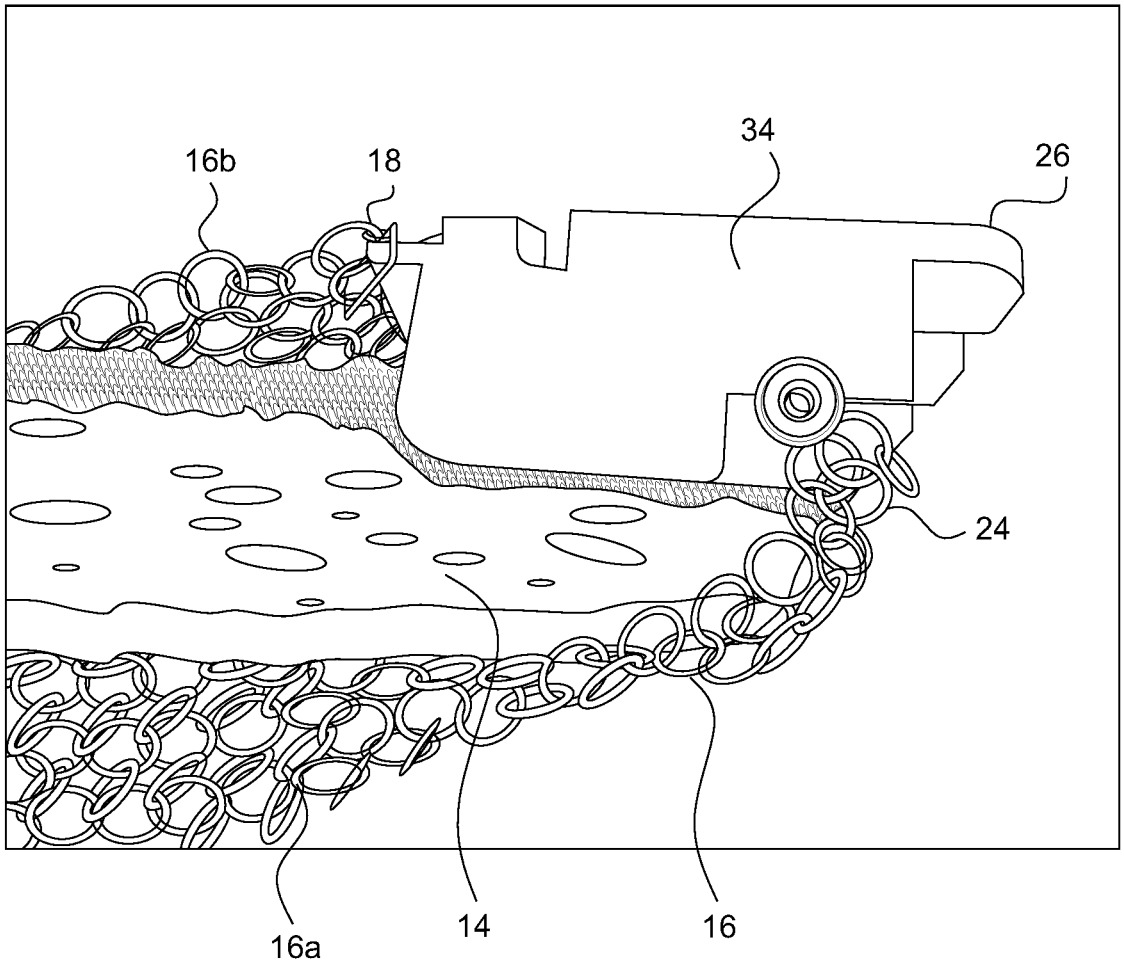
FIG. 3 is a partial view of the cleaning tool of FIG. 1 in a closed configuration.

FIGS. 1-3 illustrate an embodiment of a cleaning tool 10 for use in cleaning (cold or hot) barbeque grills and cast-iron cookware, and for other kitchen and household uses as well as food-service applications. In embodiments, the cleaning tool 10 includes a chain mail abrader embodied as a chain mail enclosure 12 that is configured to wrap around a conventional kitchen sponge 14, which provides a resiliently deformable backing that supports the chain mail while simultaneously being able to retain and dispense a cleaning solution (e.g., soap and water mixture) within the assembled cleaning tool. In embodiments, the cleaning tool also includes special scraping elements—flat and/or contoured—to assist in clearing debris around the ridges of cast iron skillets and pans.

With reference to FIG. 1, the cleaning tool 10 includes a chain mail enclosure 12 shown in the open configuration and a sponge 14. The chain mail enclosure 12 includes a chain mail sheet 16 and means for securing the chain mail sheet 16 around the sponge 14 on at least three sides of the sponge. In embodiments, a first end 18 of the chain mail sheet 16 is attached to a tail member 20, wherein the tail member 20 may be stiff or flexible and be formed from metal, plastic or a fabric. In some embodiments, permanent attachment of the first end 18 of the chain mail sheet 16 to the tail member 20 may be accomplished through staples, welding, rivets, wires, adhesive or other attachment means. In some embodiments as best shown in FIG. 2, the chain mail sheet 16 is attached to the tail member 20 using rivets 22. According to various embodiments, the attachment means may be exposed or be covered for aesthetic and/or hygienic reasons. In some embodiments, the opposite, second end 24 of the chain mail sheet 16 is attached to a head member 26, such as using one of the attachment means discussed above.

In various embodiments, the tail member 20 and head member 26 are configured to mate with one another to secure the chain mail sheet 16 in a wrapped configuration around the sponge 14 (or other resiliently deformable or even stiff backing member). For example, the tail member 20 can have male attachment member 28 shaped to be received in a corresponding female attachment member, such as a channel or recess 30 formed in the head member 26. FIG. 2 shows the male member 28 being fixedly received in the female channel or recess 30 of the head member 26. There the male member is fitted within the channel or recess 30 and frictionally retained therein to secure the tail member 20 to the head member 24, thus securing the sheet of chain mail 16 around at least three sides of the sponge 14, i.e., the top side, bottom side and at least one end of sponge 14 as shown in FIG. 2. In other embodiments, the members 20 and 26 can be configured to be secured to one another by other fastening means, including using a clip arrangement, a button arrangement, hook and loop fastener arrangement (e.g., VELCRO® fastener), buckle arrangement, or any other suitable connection arrangement that allows the ends of the chain mail enclosure 12 to be securely mated while the device is in use in a cleaning operation, while also allowing easy insertion and removal of the sponge 14.

In various embodiments, the tail member 20 and head member 26 may be permanently connected to one another. In another embodiment, the first and second ends 18, 24 of the chain mail sheet 16 may be connected directly to one another (e.g., by connecting chain mail links directly to one another) or the chain mail sheet may be connected to the head (or tail) member 26 at both ends 18, 24. In these embodiments, the sponge 14 (or other backing member) is inserted from the side into the opening between top and bottom sides of the looped over chain mail sheet 16.

In some embodiments, there may be a hinge (not shown) or another mechanism (e.g., an elastic element) to loosen the chain mail sheet (expand the effective length of the sheet) to facilitate insertion and removal of a sponge 14 or other flexible insert that provides body to the cleaning tool 10. In embodiments, a springy silicone or rubber is used to connect the ends of the chain mail (or the attached strips) to one another, allowing for some elastic give to allow for the chain mail to expand to allow for wrapping or insertion of the sponge and snug securement of the sponge within the chain mail enclosure. In various other embodiments, the flexible insert or sponge compresses in size when dry, which facilitates insertion into the area formed in the device 10 and retention through expansion (once wet) during use.

According to some embodiments of the present disclosure, the head member 26 may include a scraper 32 for cleaning around the ridges of a grill pan. In various embodiments, the scraper may be includes a straight scraping edge or an edge that is scalloped or configured as scraping teeth as shown in FIG. 2.

As best shown in FIG. 3, according to various embodiments of the present disclosure, the head member 26 may incorporate side panels 34 that define a channel 36 (FIG. 1) in which an end of the sponge 14 is received to help stabilize and capture the inserted sponge. It should be understood that an end of the sponge 14 may also is also pinched between the bottom side 16*a* of the sheet of chain mail 16 and the male member 28 of tail member 20, which also helps secure the sponge in place and provide stability. In some embodiments, the side panels 34 may be configured to be contoured to enhance the grip on the cleaning tool, particularly when directing the scrapers. In various embodiments, an extension handle may be attached to the head member 26 (not shown). In some embodiments, the handle would extend the reach and may contain a reservoir of soap (or other cleaning solution) that can be dispensed onto the retained sponge and/or onto the surface to be cleaned.

In embodiments, the chain mail sheet 16 forms a chain mail abrader surface of a chain mail abrader. The chain mail sheet 16 is constructed from a plurality of interlinked rings that form a flexible chain mail body. The sponge 14 provides an elastic member that is positioned adjacent to the chainmail body such that the elastic member is capable of applying pressure against the chainmail body to enable the chainmail body to resiliently conform to the contours of the surface that is being scraped/cleaned while applying a sufficient amount of force to remove debris without scratching, marring or otherwise damaging the surface being cleaned. Each ring of the chain mail body may be linked with two or more, three or more, four or more or five or more adjoining rings to form a single layer of chainmail material. Optionally, the chainmail body may include two or more connected chainmail layers, wherein all or select rings of two adjoining chainmail layers may be interconnected. For example, the rings positioned along a perimeter, along specific central points or along lines that traverse a central region of a chainmail layer may be interconnected with corresponding rings of an adjoining upper and/or lower chainmail layer.

By virtue of the fact that two adjoining interlinked rings 212 are movable relative to one another, two or more portions of the chainmail body are free to move in different directions relative to one another. While one portion of chainmail body may be flexed to abrade an upper surface of a grate bar, an adjacent portion may be extended and used to abrade the adjacent sides of the grate bar, for example. In an exemplary embodiment portions of chainmail body may be free to move backwards, forwards and from side to side. This design allows the cleaning tool to achieve a high degree of flexibility.

Chain mail rings can have any suitable shape, dimensions or surface texture. Exemplary rings may be circular or oval in configuration, having a diameter (in the case of a circular ring) of about 0.15 to 0.39 inches and a thickness between about 0.023 inches to about 0.045 inches. In one embodiment, two or more rings of the chain mail sheet 16 may have the same or different shape or dimensions. In embodiments, the surface of a ring can be textured to further facilitate abrasion. For example, a ring may have a plurality of abrasive elements suitable for abrading a surface and removing substances, particularly carbonized material heat sealed to a surface of the ring. Abrasive elements may be formed on the ring using for example, including, sandblasting, pitting, etching, coating, acid dipping, or otherwise texturing the ring, or a combination of these techniques. Abrasive elements may vary in size, shape, configuration and angular orientation. In one embodiment, a ring may have two or more abrasive elements having different sizes, shapes, configurations and/or angular orientations. These abrasive elements may be uniformly arranged or randomly dispersed on any surface of the ring and chainmail body. Abrasive elements may be formed along the entire surface of ring or may be formed on select portions of ring, including an upper ring surface, lower ring surface, outer ring side surface, inner ring side surface, or combinations thereof. For example, in one embodiment, the inner surface of the ring or chainmail body may be smooth while abrasive elements are formed on outer ring surface, outer ring side surface, inner ring side surface, or combinations thereof so that at least abrasive elements are positioned on outer surface of chainmail body when the chain mail sheet 16 is in the wrapped configuration shown in FIG. 2.

Additionally, it may be possible to modify the appearance of rings by sandblasting, pitting, etching, coating, acid dipping, otherwise texturing rings. For example, sandblasting may be used to turn select rings or the entire chainmail body grey, while acid treating may be used to shine rings and chainmail body.

The rings of the chain mail sheet 16 may be fabricated from any material suitable for removing debris, such as metals, metal alloys, plastics and ceramics. Exemplary materials include stainless steel, copper, other metals or metal alloys, carbon fibers, or combinations thereof. Preferably, the rings of the chain mail sheet 16 are made from stainless steel. In one embodiment, the material of the rings of chainmail body is selected to prevent or avoid scratching or marring a surface to be cleaned.

The cleaning tool 10 illustrated in FIGS. 1-3 provides a highly durable, easy to use and highly effective cleaning tool. In embodiments, the cleaning tool can be transitioned form a closed configuration (FIG. 2) to an open configuration (FIG. 1) that provides for easy cleaning of the chain mail enclosure 12 and for insertion/removal of the sponge 14 or other flexible backing member. In the closed configuration, the chain mail enclosure can be considered a pouch for receiving the sponge 14, albeit a pouch with two open ends. The chain mail enclosure 12 of the cleaning tool 10 is dishwasher safe and can be sized to work with popular kitchen sponges. The cleaning tool 10 provides an ergonomic grip and is safe for all grill pans and grill tops.

Figure 4:
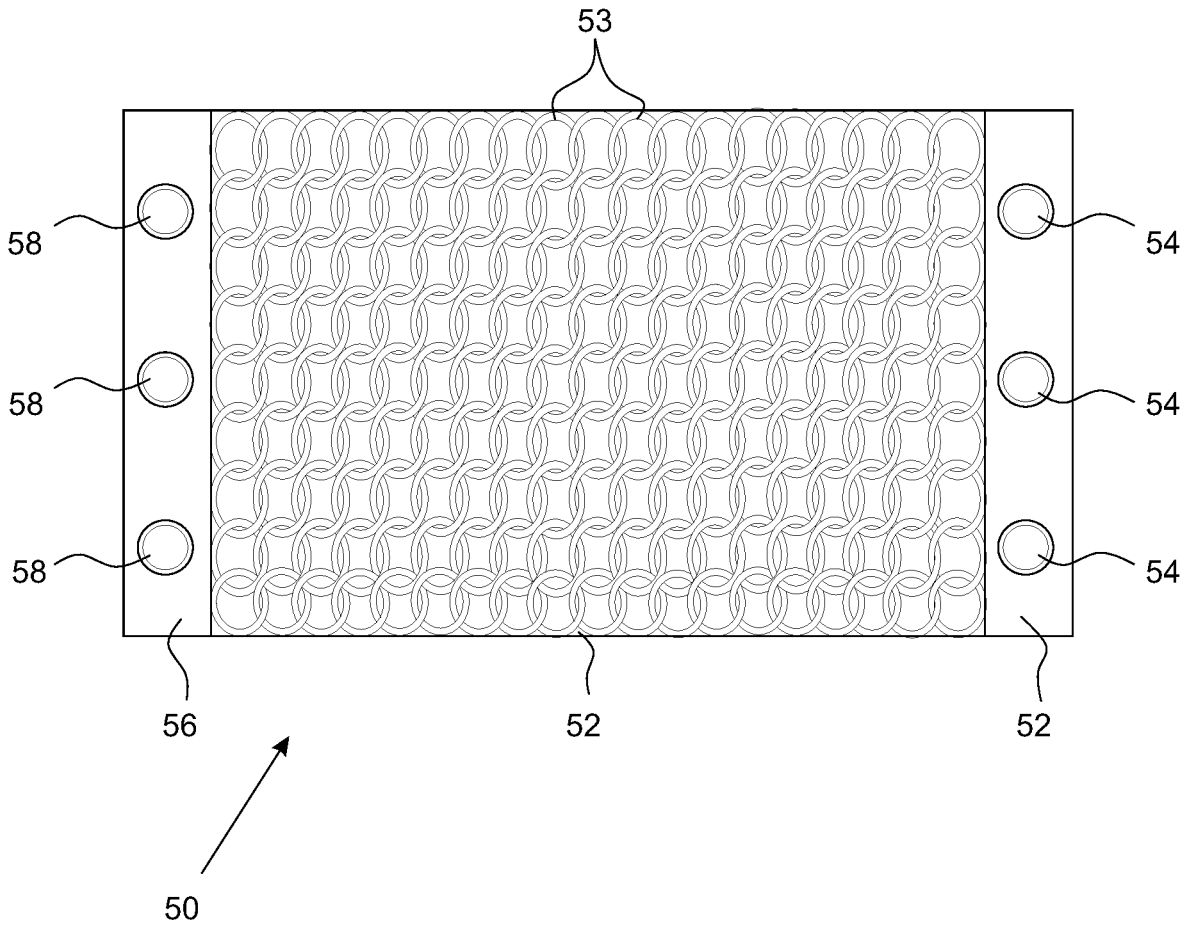
FIG. 4 illustrates an embodiment of a chain mail pouch of a cleaning tool.
Figure 5:
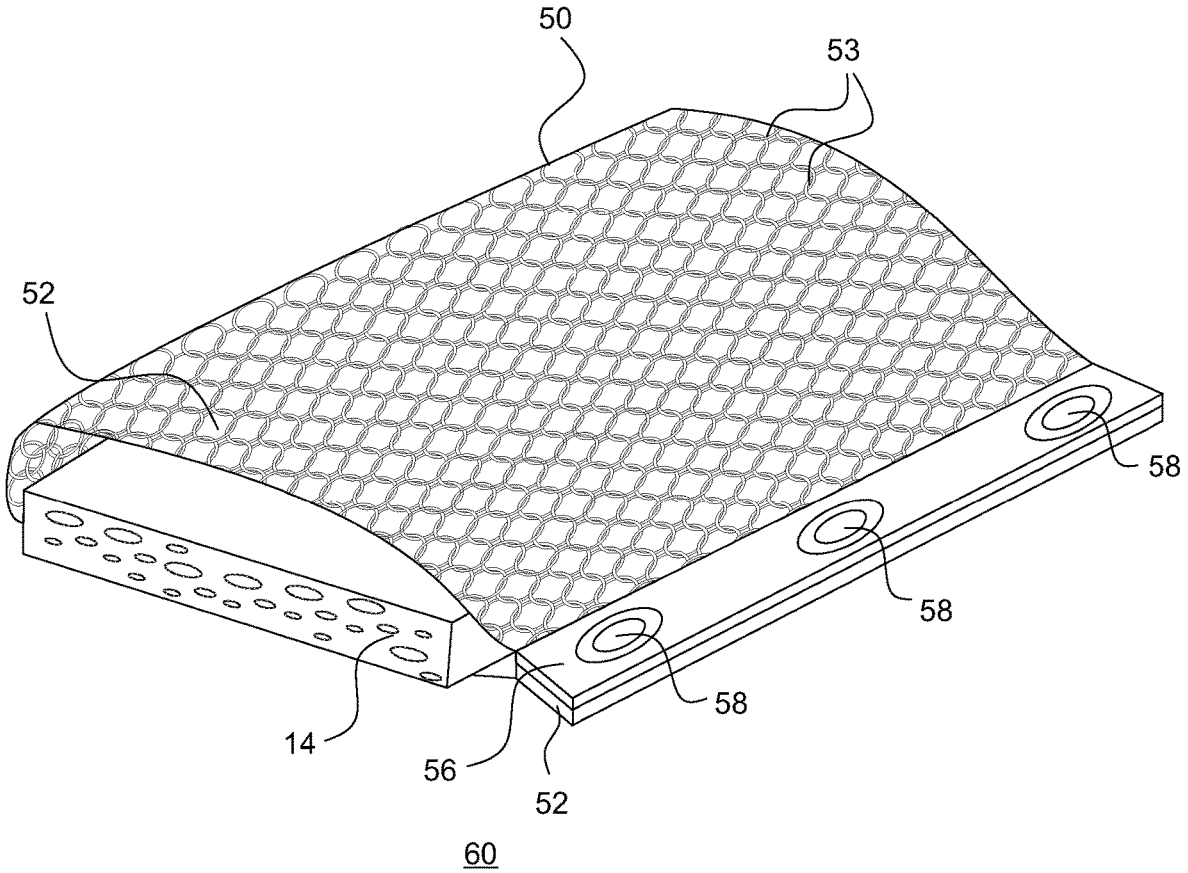
FIG. 5 illustrates the chain mail pouch of FIG. 4 secured around a sponge to form a cleaning tool.

FIGS. 4-5 illustrate another embodiment of a cleaning tool for cleaning barbeque grills, cast-iron cookware, and other kitchen and household surfaces as well as for use in food-service applications. One primary use for this tool is for cleaning cast-iron cookware. As with the embodiments described above in connection with FIGS. 1-3, this cleaning tool 60 includes a chain mail pouch 50 and a sponge 14 (or other flexible, semi-rigid or rigid backing member for insertion in the chain mail pouch 50). In various embodiments, the backing member (e.g., sponge) may be rectilinear, cylindrical, or an irregular shape. According to some embodiments, the cleaning tool is configured for cleaning a completely flat, commercial griddle surface, wherein the inserted backing member may be quite stiff.

As shown in FIG. 4, the chain mail pouch 50 includes a chain mail sheet 52 formed from interlocked chain mail rings 53. In the illustrated embodiment, the ends of the chain mail sheet 52 may be attached to first and second end members 52 and 56. The members 52, 56 may be stiff or flexible and be formed from metal, plastic or a fabric. In various embodiments, permanent attachment of the ends of the chain mail sheet 52 to the end members 52, 56 may be accomplished through staples, welding, rivets, adhesives or other attachment means. In some embodiments, the chain mail sheet 52 needs to be connected (either directly or via a member) on at least two sides. In some embodiments, the sheet is a rectangle, wherein the connection may be made either the short or the long ends. In the illustrated embodiment the connection is made on the short ends using mating male snap buttons 58 and button holes 54, which provide for a snap fit connection of the two ends of the chain mail pouch 50 together around a sponge 14 as shown in FIG. 5.

Of course, it should be understood that other methods of connecting the members 52, 56 to one another in a manner that allows for opening/unwrapping of the chain mail sheet 52 from around the sponge are contemplated. In some embodiments, the connection may be accomplished through snaps, hooks, magnets, zippers, hook and loop fasteners or other attachment means. In some embodiments, the sponge 14 should be snuggly enrobed to ensure its secure placement during use of the cleaning tool 60, i.e., during scrubbing action. In some embodiments as shown in FIG. 5, the members 52, 56 may be joined in a substantially flat layer one on top of another.

Figure 6:
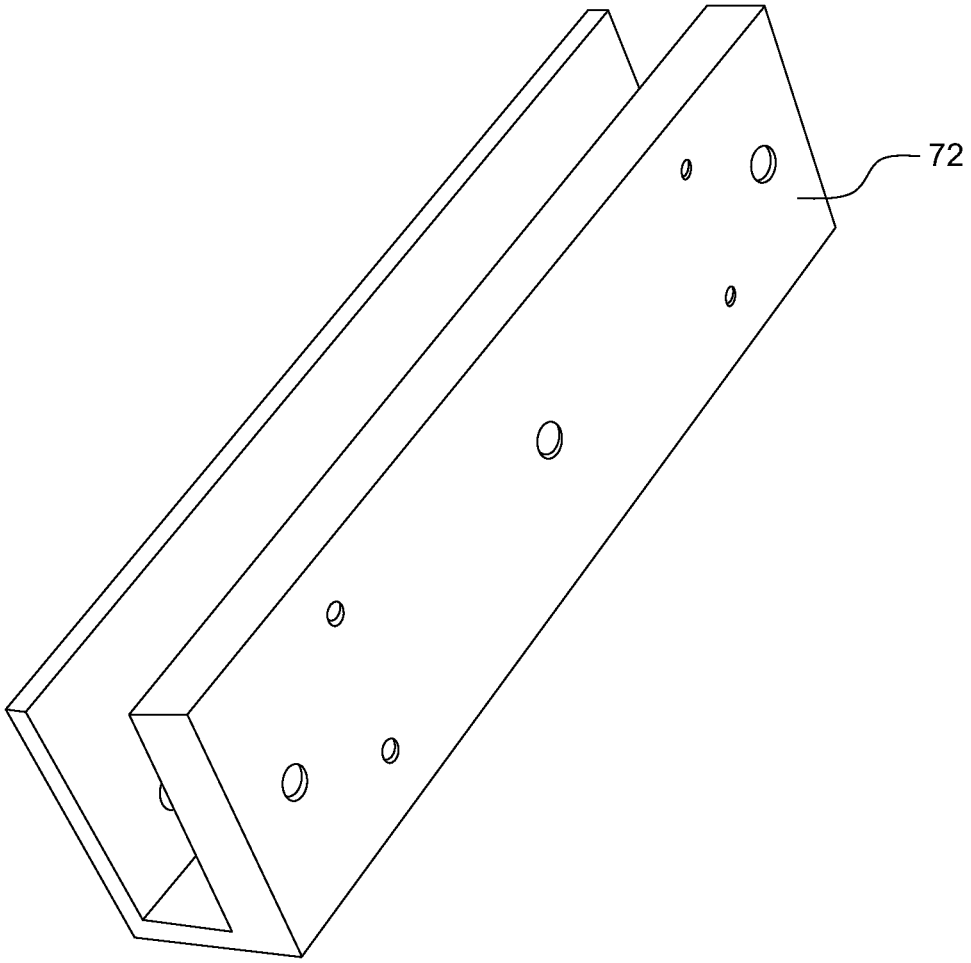
FIG. 6 illustrates an embodiment of a clip member for use in securing a sheet of chain mail around a flexible member such as a sponge.
Figure 7:
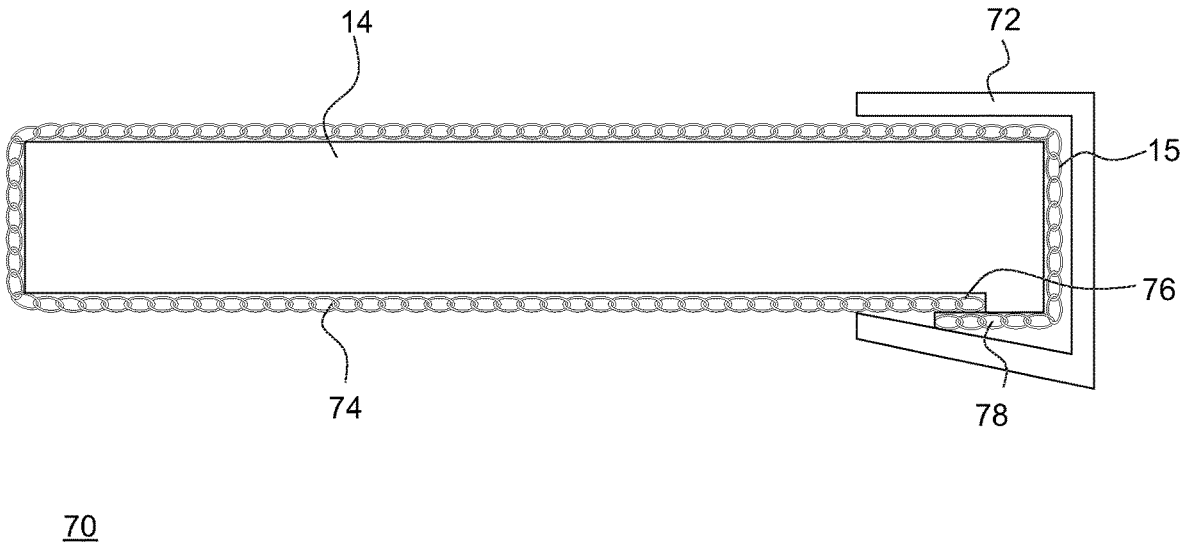
FIG. 7 illustrates an embodiment of a chain mail abrader cleaning tool using the clip member of FIG. 6.

FIGS. 6 and 7 illustrate another embodiment of a cleaning tool 70 including a chain mail pouch and a sponge 14. In this illustrated embodiment, end members are not permanently attached to the sheet of chain mail 74. Rather, a single end member 72, which is shown in FIG. 6, is provided and configured to serve as a clip. The cleaning tool 70 is formed by wrapping a chainmail sheet 74 around the periphery of a sponge 14 (or other flexible or resilient member), preferably with the opposite ends 76, 78 of the sheet 74 overlapping one another proximate a side 15 of the sponge 14. The end member 72 is then disposed over the longitudinal (or end) edge of the sponge 14 and partially over the chain mail sheet 74 to secure the chain mail sheet in place around the sponge 14. In embodiments, the end member 72 is U-shaped, or generally U-shaped with a slightly closed open end such that it is tapered. By stabilizing the sponge, the end member 72 also forms a grip. In various embodiments, the grip may be configured to incorporate scraping elements projecting out either in the plane of the sponge or at any angle. In some embodiments, the scraping element is configured to be flat or have feature cutouts to match the contour of the ridges of (for example) a grill pan.

In various embodiments, the chain mail may be permanently attached to itself to form a single chain mail member that is shaped to form a pouch, either with one or two open ends (or sides) for receiving a sponge or other flexible, resilient or semi-resilient backing member. If there is no way to increase the effective surface area of the enrobing chain mail, insertion and removal of the sponge may be accomplished when the a sponge is compressed, e.g., when dry. Expansion of the sponge when wet helps to firmly secure the sponge within the chain mail pouch, according to various embodiments.

Figure 8A:
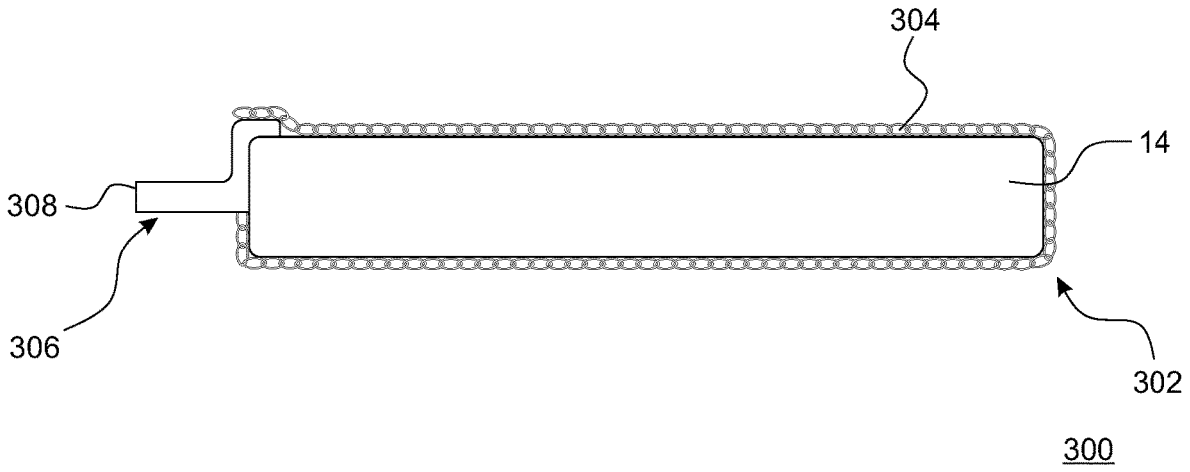
FIGS. 8A-8B illustrates an embodiment of a chain mail pouch having a scraper.
Figure 8B:
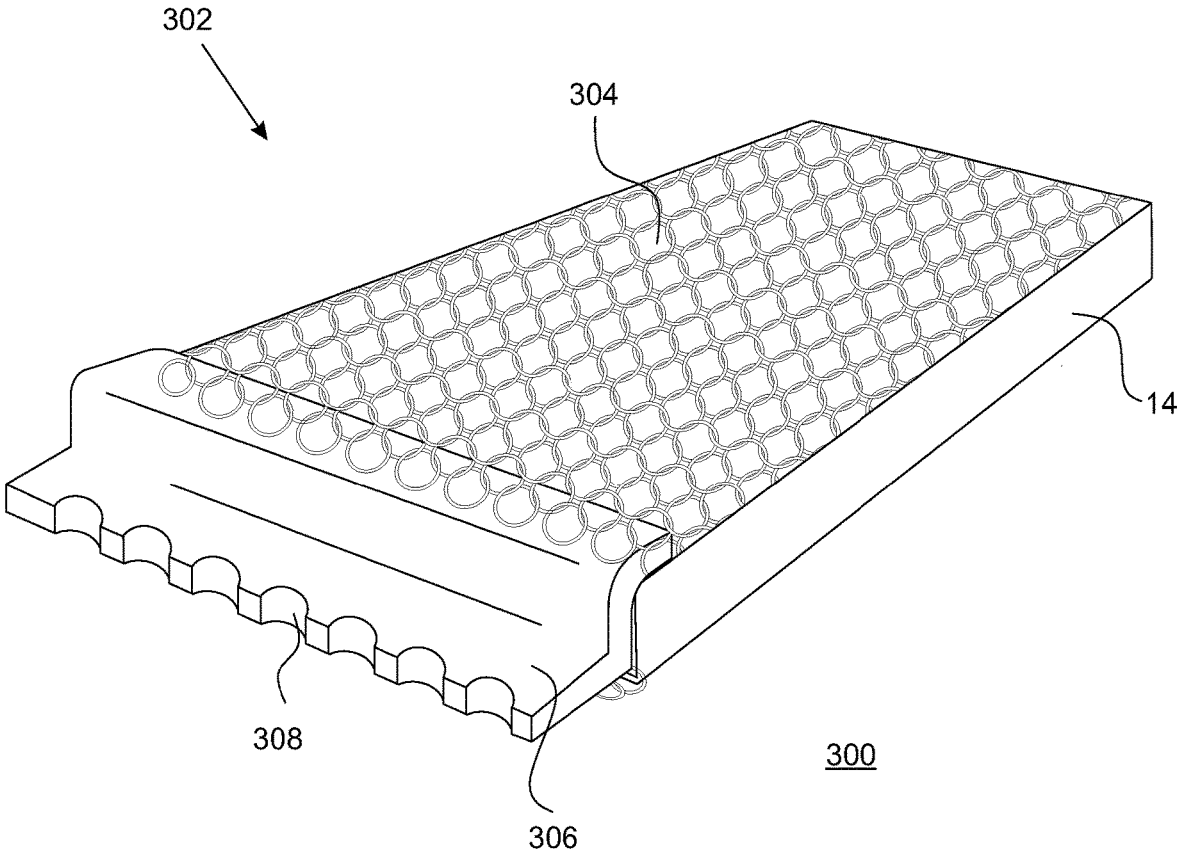

FIG. 8A illustrate a side elevation view of a cleaning tool 300 having a scraper and FIG. 8B is a perspective view of the cleaning tool 300. As with the embodiments of FIGS. 1-7, the cleaning tool 300 includes a flexible backing member, such as a silicone sponge 14. The cleaning tool includes a chain mail enclosure 302 having a chain mail body 304 wrapped around the top and bottom sides of the sponge 14 and at least one end thereof. Ends of the chain mail body 306 can be removably coupled to one another (directly or indirectly through the scraper head 306) in the manner described above in the embodiments of FIGS. 1-7 to allow for the chain mail body to wrap around a sponge. In other embodiments, the chain mail enclosure can be so sized or otherwise configured (e.g., with a hinge or elastomer portion) that allows for expansion such that a sponge insert 14 can be disposed within the chain mail enclosure 302. In the illustrated embodiment, the chain mail body 304 is coupled to a scraper head 306 having a scraper edge 308 configured for scraping of a surface to be abraded, e.g., a grill. The scraper head 306 can be formed from stainless steel, hard plastic, composite or other material suitable for its intended scraping purpose. The chain mail body 304 can be coupled to the scraper head 306 in any appropriate manner, including by screws, rivets, button connection, adhesive or combination thereof. In embodiments, one end of the chain mail body 304 can be permanently connected to the scraper head 306, e.g., with rivets, while the other end of the chain mail body is detachably coupled to the scraper head 306 so as to allow for the chain mail body 304 to be detachably coupled around the sponge insert 14.

Figure 8C:
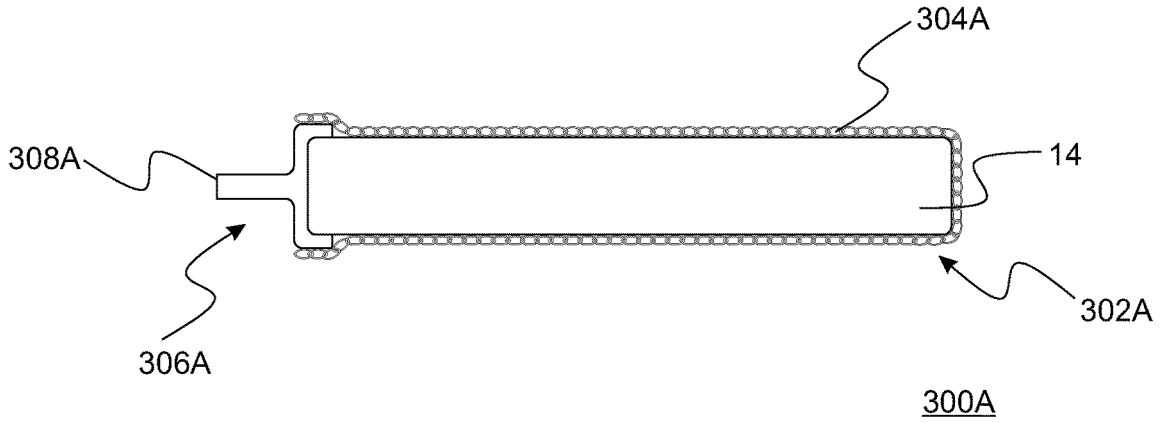
FIGS. 8C-8D illustrate another embodiment of a chain mail pouch having a scraper.
Figure 8D:
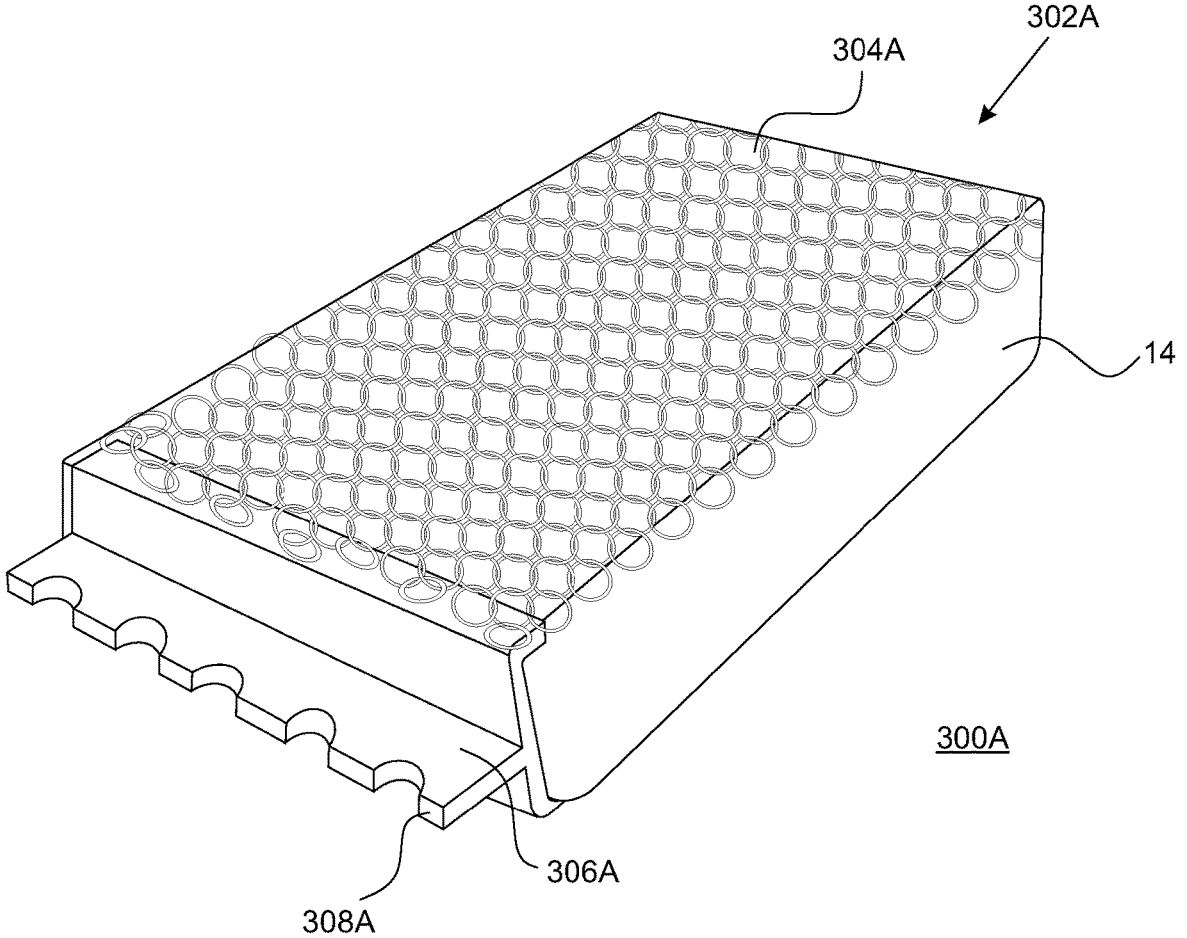

FIGS. 8C and 8D illustrate an alternative embodiment of a cleaning tool 300A. FIG. 8C is a side elevational view of the cleaning tool 300A and FIG. 8D is a perspective view of the cleaning tool 300A. As compared to FIGS. 8A and 8B, like features are designated with the same reference number but with an additional "A". The cleaning tools 300A and 300 are identical except with respect to the scraper head 306A, 306, respectively. Whereas the scraper head 306 has an "L" shaped body connecting to the chain mail body 304 that covers at least part of the ends of the sponge 14 and a portion of the top of the sponge, the scraper head 306A of FIGS. 8C and 8D has a "U" or "C" shape such that it covers an entire end of the sponge 14 and portions of the top and bottom surfaces thereof.

Figure 8E:
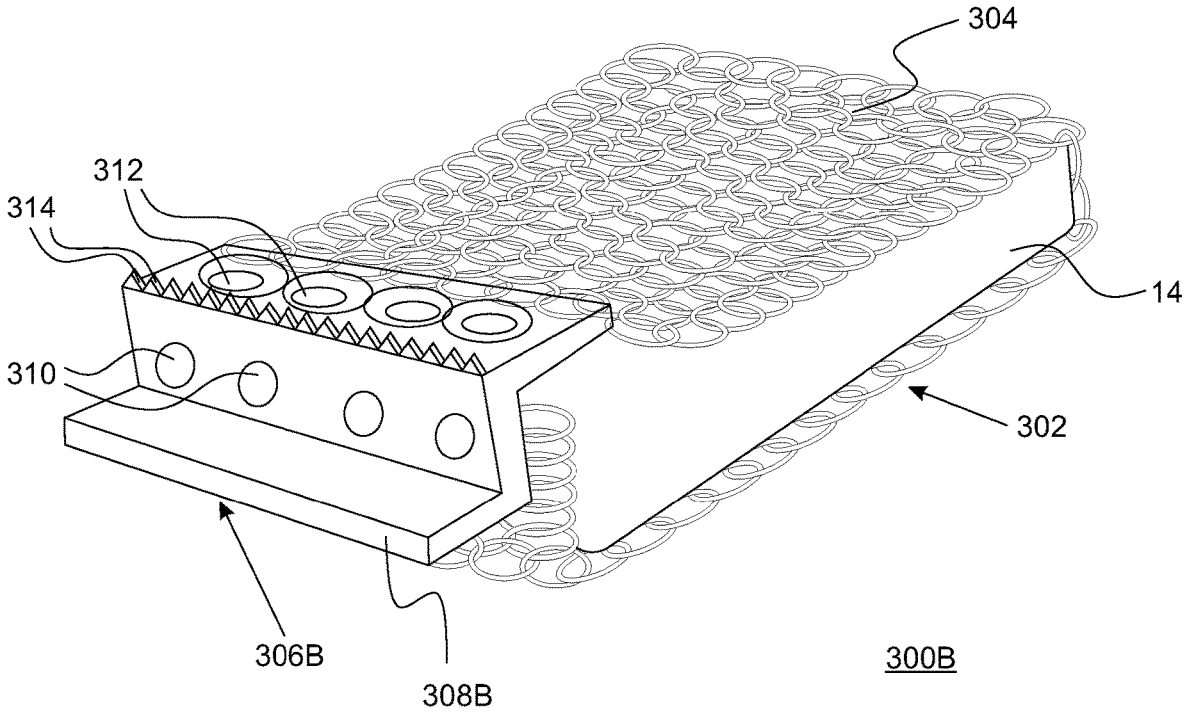
FIG. 8E illustrates another embodiment of a chain mail pouch having a scraper.

FIG. 8E illustrates an alternative embodiment of a cleaning tool 300B. The cleaning tool 300 and cleaning tool 300B are identical except with respect to the scraper heads 306 and 306B, respectively. As shown in the embodiment of FIG. 8E, the scraper head 306B includes two scraper edges, a first scraper edge 308B and a second scraper edge 314. In embodiments, the first scraper edge 308B has a substantially straight scraper blade edge whereas second scraper edge 314 is serrated. As also shown in FIG. 8E, a first set of rivets 310 or other connector is sued to connect the scraper head 306B to a first end of the chain mail body 304 and a second set of rivets 312 or other connector is used to connect the scraper head 306B to a second end of the chain mail body 304.

Figure 9:
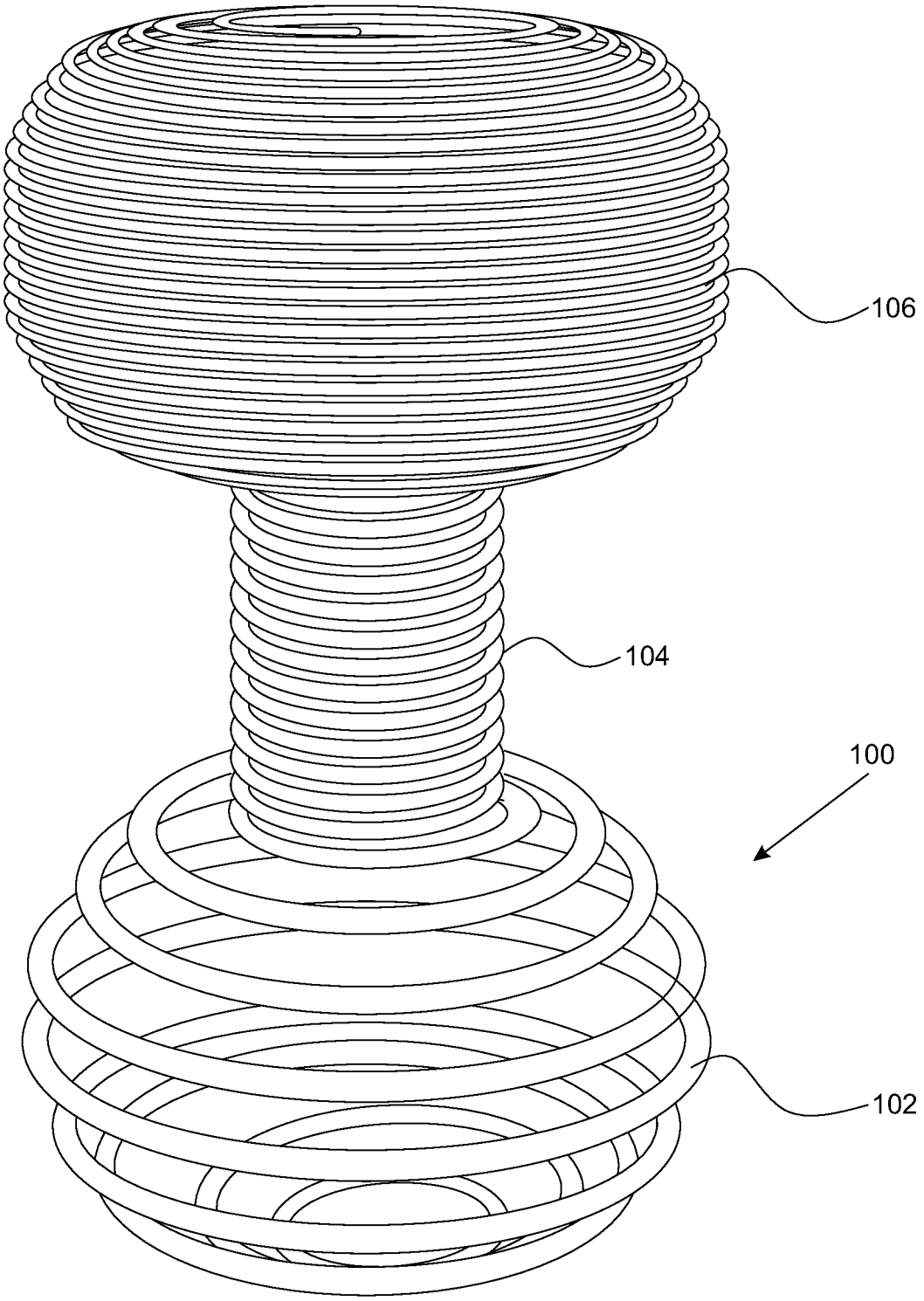
FIG. 9 illustrates an embodiment of a coil member.
Figure 10:
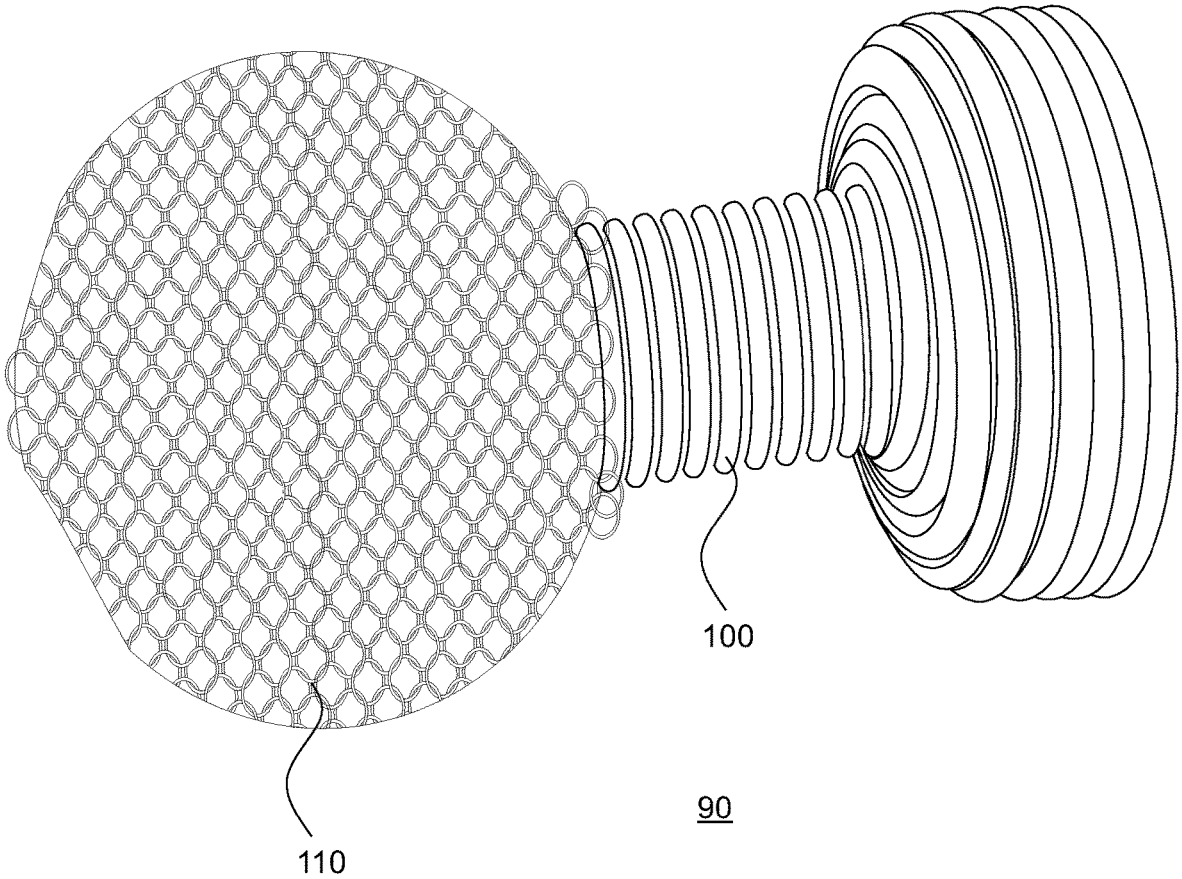
FIG. 10 illustrates a spring-backed cleaning tool including the coil member of FIG. 9 with a chain mail abrader bonnet attached thereto.

FIGS. 9 and 10 illustrate another embodiment of a cleaning tool, specifically a spring-backed cleaning tool 90 and components thereof. In embodiments, the spring-backed cleaning tool 90 includes a wire form coiled member 100 that provides a spring body for supporting the chain mail abrading surface. In embodiments, the wire form coiled member 100 also provides a grip that serves as a handle.

With reference to FIG. 9, a wire form coiled member 100 is shown. In embodiments, the wire form coiled member includes three distinct parts, including a bulbous handle 106, a stem or shaft 104 extending from one end to the bulbous handle 106, and a bulbous spring 102 extending from the other end of the shaft 104. In embodiments, bulbous handle 106, shaft 104 and spring 102 are formed from one continuous piece of thick gauge wire (hence the use of the term "wire form" in this disclosure) that is wound into the shape illustrated in FIG. 9. In embodiments, the wire of the wire form is formed from the same material as the chain mail, for example, stainless steel. In embodiments, the wire that forms the coiled member 100 has a gauge between 1/16 to 3/32 inches. Bulbous handle 106 and shaft 104 are formed from tightly wound coils of the wire, with little or no space between adjacent coils. This configuration makes the handle 106 and shaft 104 substantially rigid. In contrast, the wire coils that form the bulbous spring 102 are spaced from one another a sufficient distance to form spring 102.

With reference to FIG. 10, the chain mail is provided to completely or substantially cover (i.e., at least 75% of the surface area) the spring 102 of the wire form coiled member 100. In embodiments, the chain mail is provided in the form of a chain mail bonnet 110 disposed over, and general taking the shape of, the bulbous spring 102. The chain mail bonnet 110 provides a chain mail abrader surface that is supported by the spring 102, which allows the chain mail bonnet to resiliently deform to conform to a surface being cleaned when in use.

In some embodiments, the bonnet may be any shape to optimize connection to the underlying wire form spring 102. One advantages of this embodiment is its simplicity, in that the components (including the chain mail 110 and wire form coiled member 100) are all equally durable and easy to clean (when compared to a sponge, even when made of closed cell silicone that ultimately is more durable than a typical household sponge but not as durable as the chain mail).

According to some embodiments, the wire form coiled member 100, including its spring element 102 may be made from any suitable material, including wire rope having more than two would wire bristles.

In various embodiments, such as shown in FIG. 10, the chain mail bonnet 110 is configured to be permanently affixed to the coiled member 100.

In other embodiments discussed below, the chain mail bonnet is configured to be easily removed from the wire form coiled member for cleaning the spring 102 as well as the chain mail bonnet. In various embodiments, the bonnet may be a different shape and attached via clips, ties or another mechanism either directly to the underlying wire form or via an intermediary frame.

It should be understood that in place of the wire form coiled member 100 formed from a single wire, the shaft 104 and handle 106 may be replaced with a non-wire form component (e.g., a shaped metal, wood, or composite body) to which the spring 102 is connected.

Figure 11:
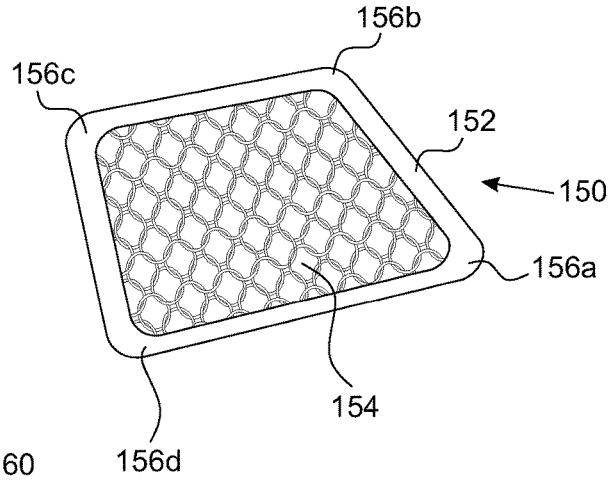
FIG. 11 illustrates an embodiment of chain mail abrader formed from a sheet of chain mail and an open frame member.
Figure 12A:
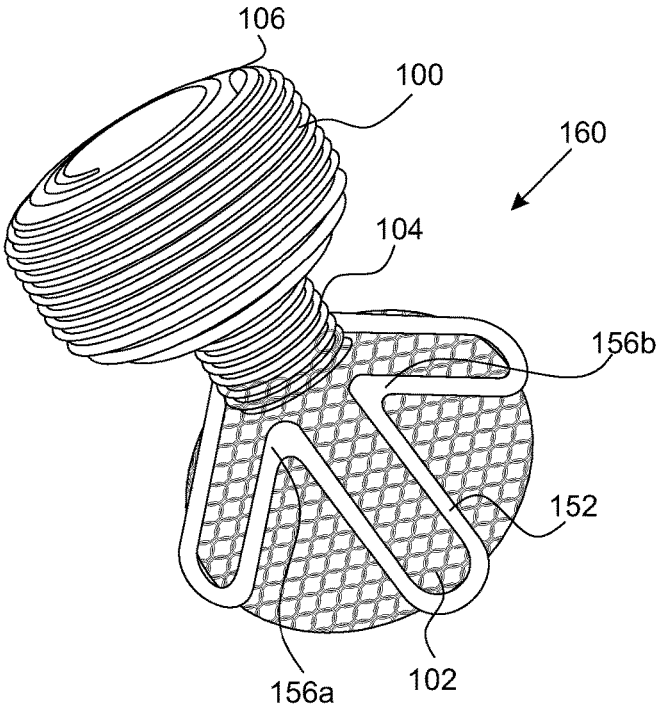
FIGS. 12A and 12B illustrate an embodiment of a cleaning tool having the chain mail abrader of FIG. 11 attached to the coil member of FIG. 9.
Figure 12B:
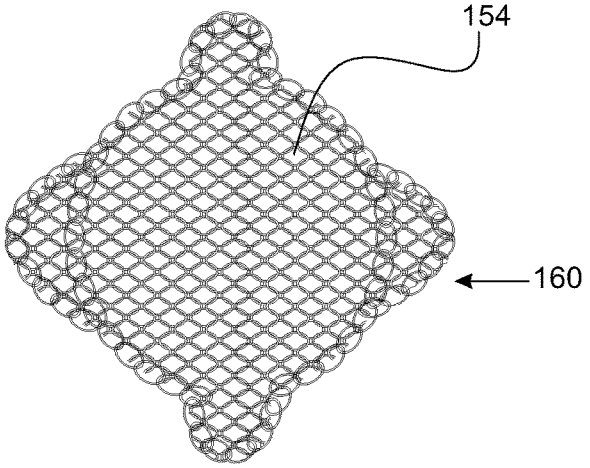

FIGS. 11 to 12B illustrate an embodiment of a removable chain mail abrader. The cleaning tool 160 includes the same wire form coiled member 100 shown and described above in connection with FIG. 9. In this embodiment, the chain mail bonnet is formed from a rectangular chain mail abrader element 150 shown in FIG. 11. The chain mail abrader element 150 includes an open frame member 152, which in embodiments is formed in a square shape having four corners 156*a*, 156*b*, 156*c*, and 156*d*. In embodiments, the frame can take on other shapes, such as a circular ring shape. A square (in the embodiment of FIG. 11) shaped sheet of chain mail 154 is attached to the open frame member 152 and covers the opening in the open frame member 152. The sheet of chain mail 154 can be attached to the frame in any suitable manner, e.g., by welding, clips, rivets, wires bonds, or other suitable manner that securely attaches the sheet of chain mail 154 to the frame. The frame 152 is formed from a material that is non-resiliently deformable such that it can be folded or bent, e.g., at its corners 156, around the spring 102 to attach the chain mail abrader element 150 to the coiled member 100, as shown in FIGS. 12A and 12B. The chain mail abrader element 152 can be unfolded to remove it from the coiled member to allow for cleaning of the spring 102 and chain mail abrade element 152. The chain mail abrader 150 can then be reattached to the spring 102 as discussed above. One advantage of the embodiment of FIGS. 11-12B when compared to the embodiment of FIGS. 9-10 is that it is easier to cut square shaped sheets of chain mail (when compared to shapes that do not have hard edges) and there is, therefore, less or no waste of chain mail material.

In some embodiments, the spring bush does not include a distinct handle. According to various embodiments, where a distinct handle is not present, the user could grasp the wire form spring through the chain mail in which case the wire form spring provides a grip for the tool (similar to the chain mail pouch embodiments discussed above). In various embodiments, the pouch may be a bonnet shape and configured to be substantially round with an opening into which a compressed, circular sponge may be inserted from the rear.

Figure 13A:
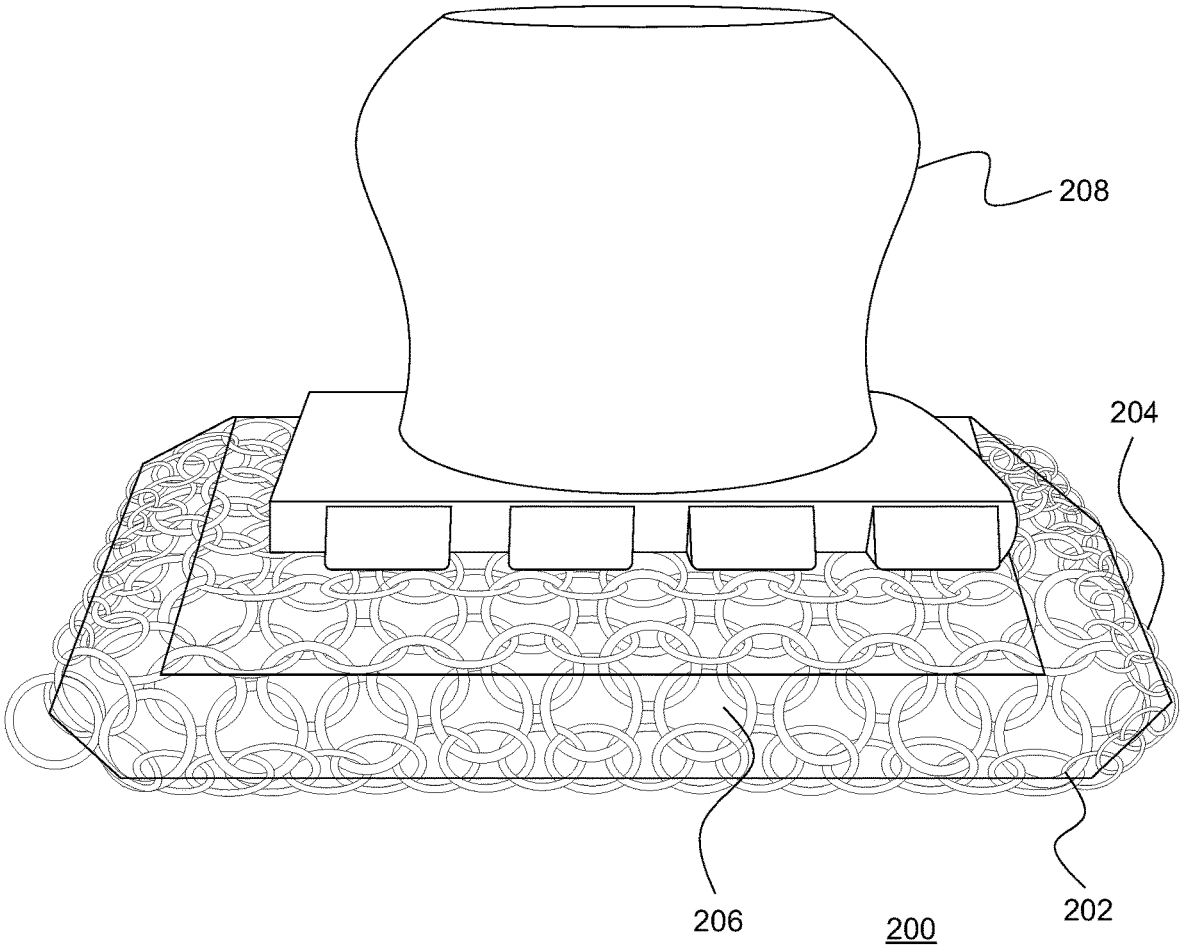
FIG. 13A to 13C illustrate an embodiment of a cleaning tool having a detachable handle.
Figure 13B:
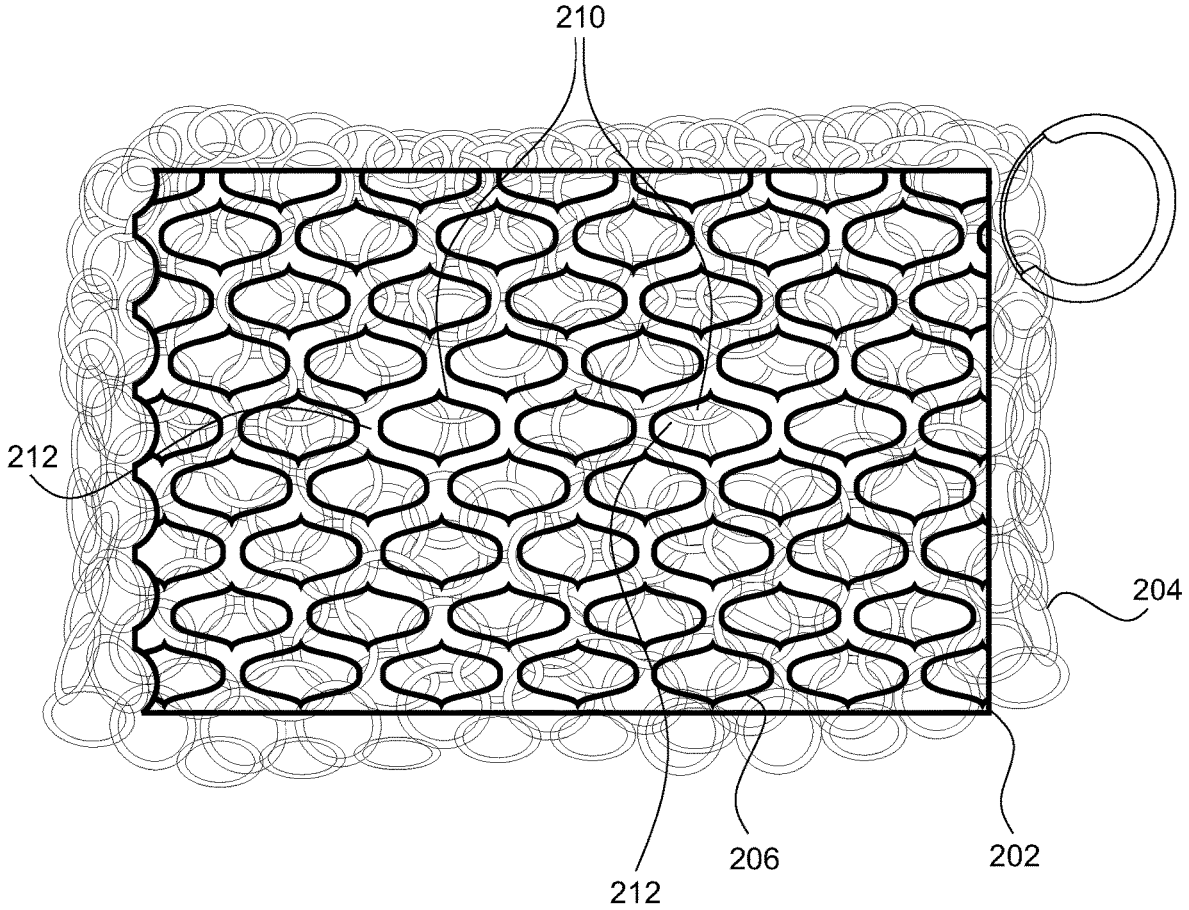
Figure 13C:
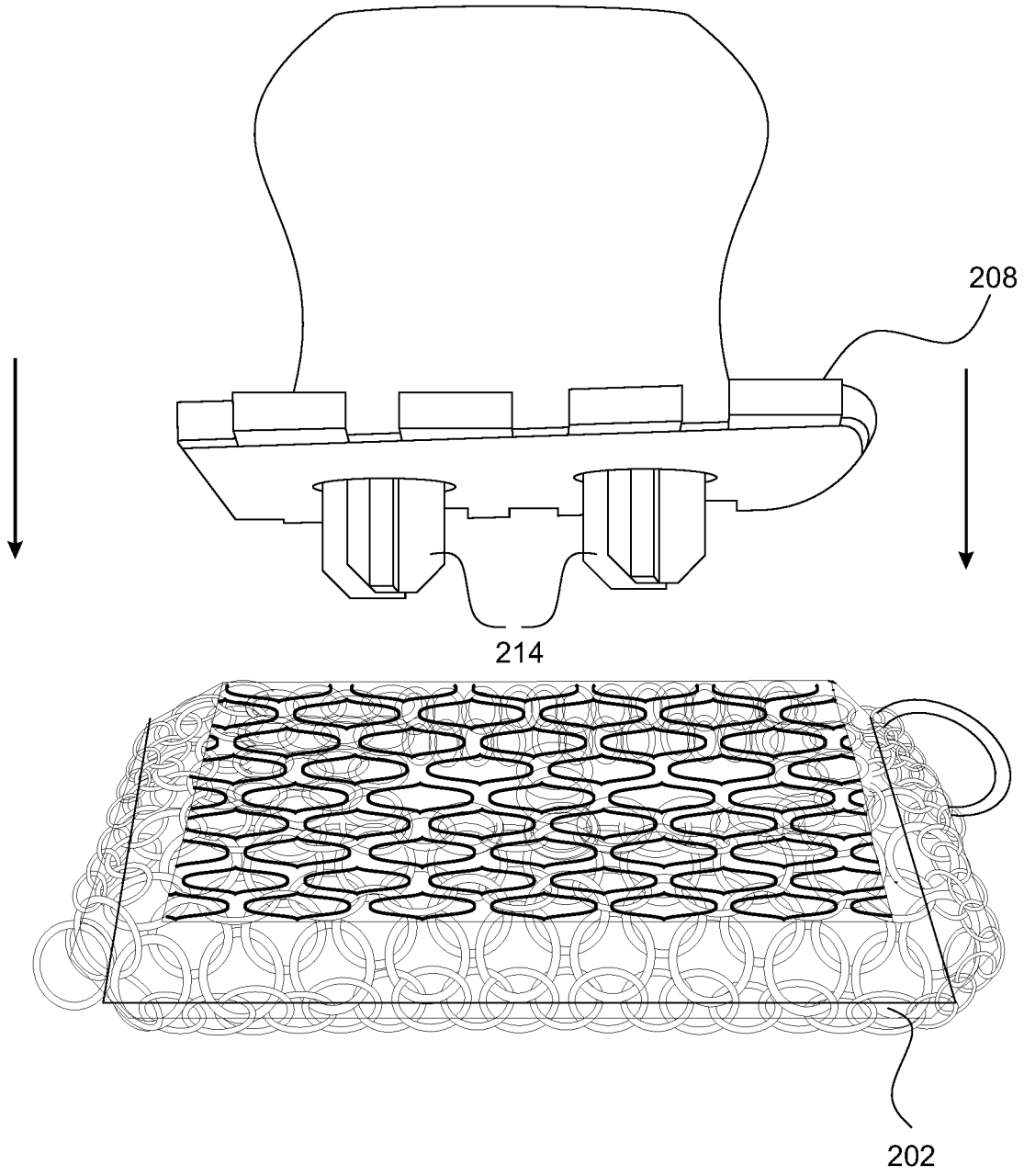

FIGS. 13A to 13C show another embodiment of a cleaning tool. In this embodiment, the cleaning tool 200 includes a chain mail cleaning tool 202 having a chainmail body 204 completely surrounding a sponge insert 206. In the illustrated embodiment, the sponge insert 206 is a silicone sponge with a honeycomb body including at least two openings 210 therein. The cleaning tool includes a detachable handle 208 that configured to be detachably connected the sponge body, specifically by insertion members, such as one or more prongs 214, that are sized to fit snuggly (i.e., create a friction fit) with mating openings 210 in the sponge. In embodiments, the chain mail body includes openings 212, allowing access to the openings 210 for one or more insertion members. In embodiments, the handle can have a reservoir (not shown) for holding a cleaning fluid which could be dispensed into/through the sponge. In embodiments, the handle can be longer to facilitate cleaning of hot surfaces.

Figure 14A:
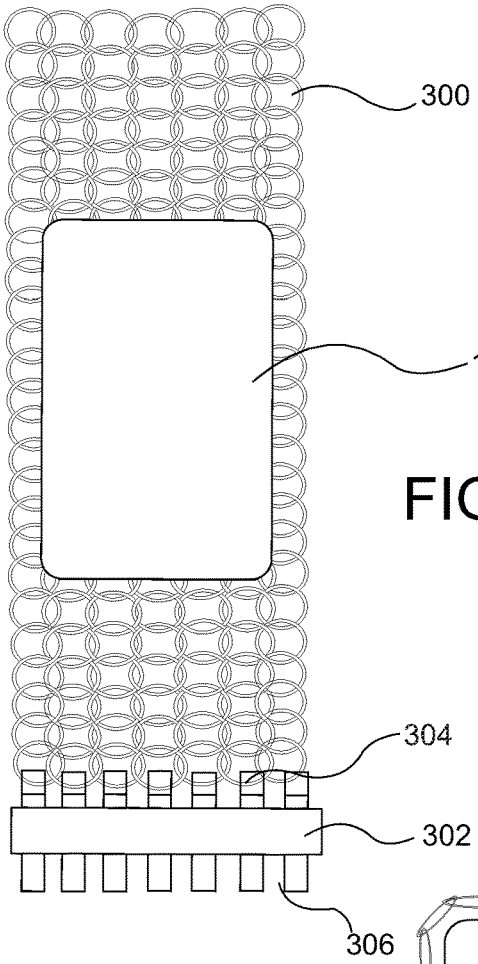
FIGS. 14A to 14C illustrate another embodiment of a cleaning tool.
Figure 14B:
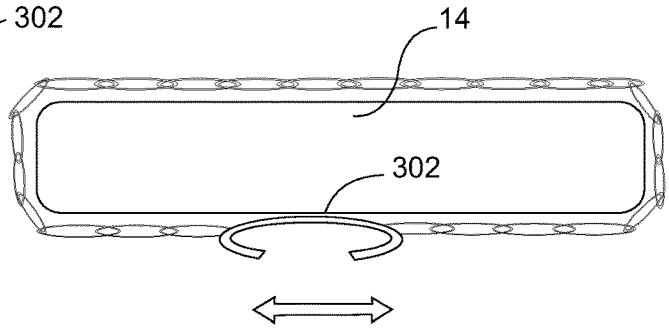
Figure 14C:
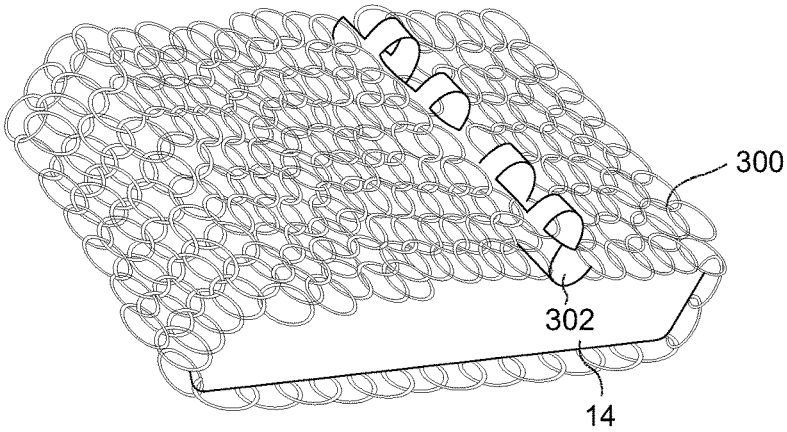

FIGS. 14A to 14C illustrate another embodiment of a cleaning tool. FIG. 14A shows the cleaning tool in an open configuration and FIG. 14C shows the tool in a closed configuration, with chain mail body 300 securely wrapped around backing member insert 14 (e.g., a sponge). A connection member 302 is used to connect the two end of the chain mail body 300 to one another when wrapped around the sponge. In embodiments, the connection member includes a first set of teeth 304 that connect to chain mail links at a first end of the chain mail body 300 and a second set of teeth 306 that connect to chain mail links at a second end of the chain mail body 300. In embodiments, the connection member 302 can be made of plastic or metal and preferably is resiliently flexible such that it is expandable, allowing the teeth 304, 306 to be flexed to mate with the chain mail body 300 when the chain mail body is wrapped around the backing member 300 and then after connection to apply sufficient force to securely retain the chain mail body 300 wrapped around the backing member.

Figure 15A:
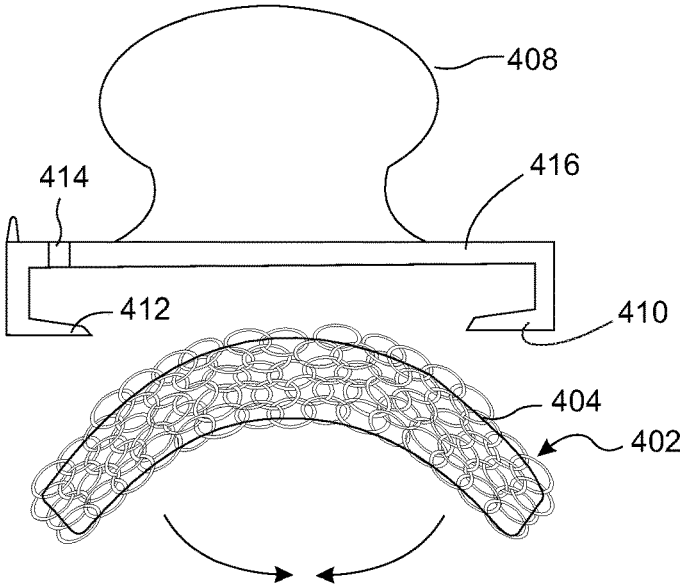
FIG. 15A to 15C illustrate another embodiment of a cleaning tool having a detachable handle.
Figure 15B:
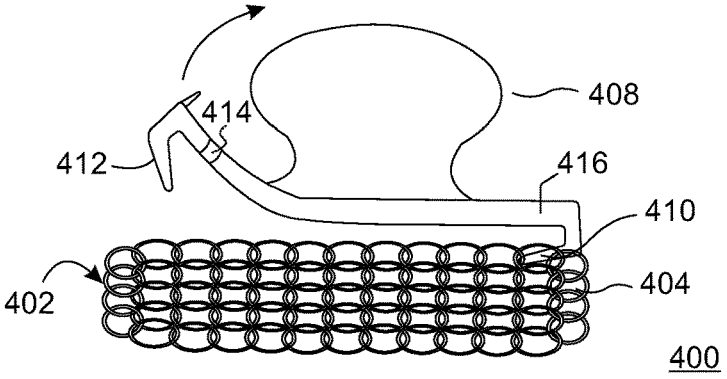
Figure 15C:
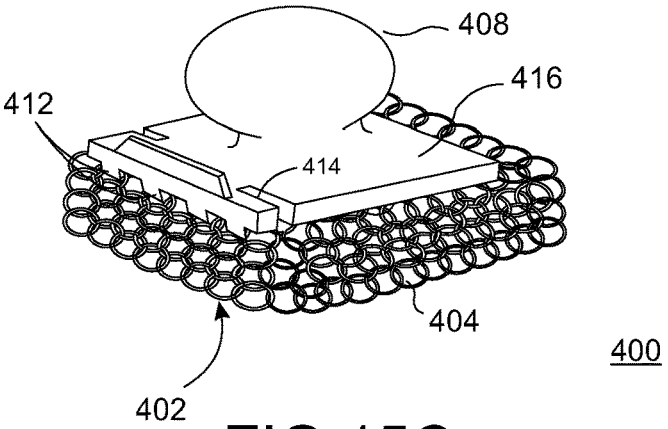

FIGS. 15A to 15C show another embodiment of a cleaning tool having a detachable handle. In this embodiment, the cleaning tool 400 includes a chain mail cleaning tool 402 having a chainmail body 404 completely surrounding a sponge insert. In embodiments, the sponge insert may be a silicone sponge with a honeycomb body. It should be appreciated that the openings in the body of the sponge allow the silicone insert to be resiliently deformable. The cleaning tool includes a detachable handle 408 that is configured for detachable connection to the chain mail cleaning tool 402. As shown in the figures, the detachable handle 408 includes opposite facing sets of teeth 410, 412 that are positioned for gripping opposites sides of the chain mail cleaning tool 402 and securing the handle 408 to the cleaning tool 402. In embodiments the teeth can be substantially fixed with respect to one another, and the chain mail cleaning tool 402 can be flexed (as shown in FIG. 15A) to connect the cleaning tool 402 to the handle. Alternatively, or additionally, the handle 408 can be provided with one or more living hinges 414 in a base section 416, the underside of which the teeth 410, 412 are connected to, that allows an end of the handle 408 to flex, thereby facilitating connection of the teeth (e.g., 412) to the tool 402. Of course, the handle 408 can also be formed from a material, such as a suitable plastic, that is sufficiently flexible to allow for sufficient flexing of the handle to facilitate connection of the teeth to the tool 402.

Figure 16A:
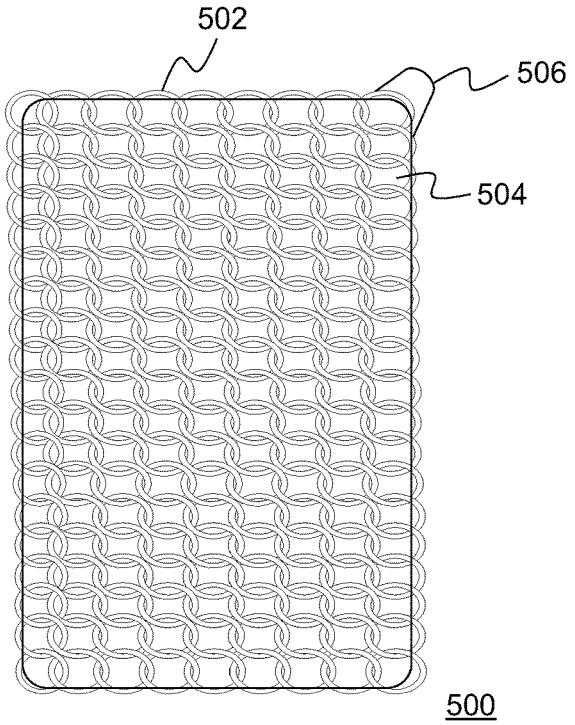
FIG. 16A to 16C illustrate another embodiment of a cleaning tool.
Figure 16B:
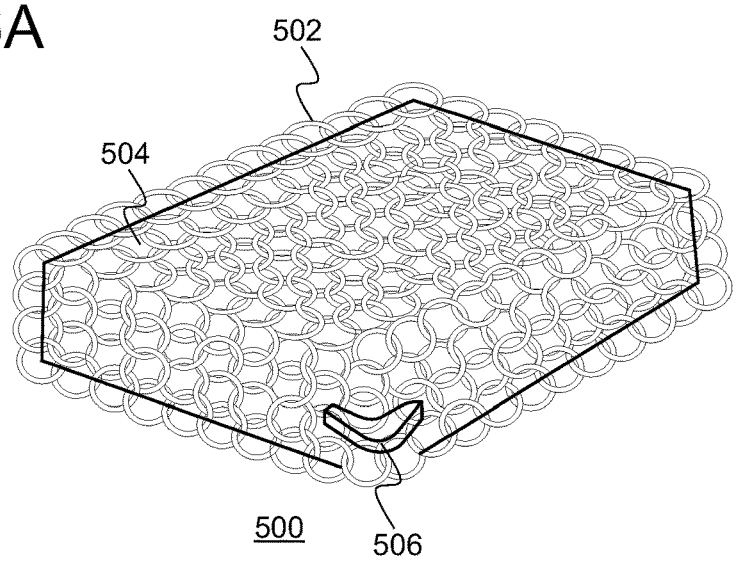
Figure 16C:
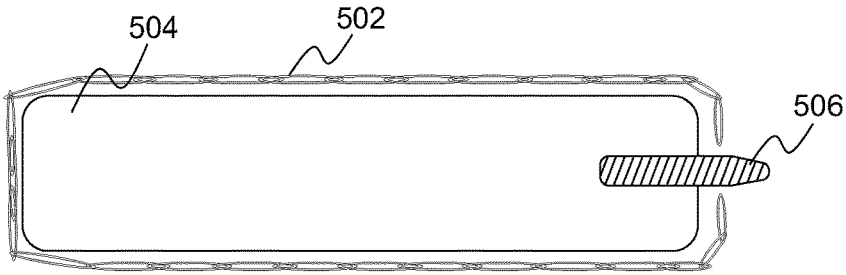

FIGS. 16A to 16C illustrate another embodiment of a cleaning tool 500. FIG. 16A is a top side view of the cleaning tool 500. FIG. 16B is a perspective view of the cleaning tool 16B. FIG. 16C is a cross-sectional view of the cleaning tool 500. In the illustrated embodiment, a chain mail body 502 is disposed entirely around and secured to a backing member 504, such as a silicone sponge. In the illustrated embodiment, the silicone sponge is provided with a scraping member 506 that protrudes through the chain mail body 502. The scraping member 506 may be embedded within or otherwise connected to the body of the backing member 504. In the illustrated embodiment, the scraping member 506 is positioned at a corner of the backing member 504, and thus at a corner of the cleaning tool 506, and at a positioned midway up the body of the backing member 504. This configuration maximizes the surface area of the chain mail body, i.e., there is minimal interference with the major chain mail body surfaces that are used for abrading. Of course, in other embodiments, the scraper member may be located otherwise, such as along all or part of a side surface of the cleaning tool 500. In embodiments, the scraper member can be made of any rigid surface suitable for providing a scraper with a scraper edge for removing stubborn material from a surface to be abraded, such as a hard plastic, stainless steel, composite or other suitable material.

It should be appreciated that in certain embodiments, the backing member may be substantially rigid. For example, a silicone insert with no openings, i.e., a solid block of silicone, is substantially rigid. Other examples may be a rigid block of wood, hard plastic, ceramic, composite or metal. This backing member may be used to create a tool for applications such as paint removal, and be used with any embodiment described herein.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A cleaning tool for use in abrading a surface for cleaning the surface, comprising:

a resiliently deformable backing member insert; and a chain mail abrader enclosure comprising a chain mail body having a plurality of interlinked rings, wherein the chain mail abrader enclosure is configured to allow for insertion and removal of the resiliently deformable backing member insert, wherein the resiliently deformable backing member is disposable within the chain mail abrader enclosure such that the backing member is positioned against the chain mail body to allow the chain mail body to conform to contours of the surface during abrading;

wherein the chain mail abrader enclosure comprises a sheet of chain mail having a first end of the sheet detachably coupled to a second end of the sheet; and wherein the chain mail abrader enclosure includes a first member attached to the first end of the sheet and a second member attached to the second end of the sheet, wherein the first and second members are configured for detachable coupling with one another.

2. The cleaning tool of claim 1, wherein the resiliently deformable backing member is a sponge.

3. The cleaning tool of claim 2, wherein the sponge is formed from a foamed plastic polymer.

4. The cleaning tool of claim 2, wherein the sponge is formed from closed cell silicone.

5. The cleaning tool of claim 1, wherein the first member includes a female connector and the second member includes a male connector.

6. The cleaning tool of claim 5, wherein the first member includes a channel for receiving an end of the backing member, wherein the backing member is frictionally engaged with the first member within the channel to secure the backing member.

7. The cleaning tool of claim 1, further comprising a detachable handle coupled to the chain mail abrader enclosure.

8. The cleaning tool of claim 1, further comprising a scraper head with a scraping edge coupled to the chain mail abrader enclosure.

9. A cleaning tool for use in abrading a surface for cleaning the surface, comprising:

a chain mail abrading device comprising:

a sponge; and a chain mail enclosure, the chain mail enclosure having a chain mail body having a plurality of interlinked rings;

wherein the sponge is disposed within the chain mail abrader enclosure such that the sponge is positioned against the chain mail body to allow the chain mail body to conform to contours of the surface during abrading; and wherein the sponge includes a scraping member with a scraping edge connected thereto and positioned to protrude through the chain mail body of the chain mail enclosure; and a handle detachably coupled to the chain mail abrading device.

10. The cleaning tool of claim 9, wherein the handle comprising at least one insertion member on a bottom side thereof for creating a frictional fit in an opening in the sponge, thereby coupling the handle to the chain mail abrading device.

11. The cleaning tool of claim 9, wherein the handle comprises two or more gripping claws for detachably coupling the handle to the chain mail abrading device.

* * * * *